United States Patent [19]

Bucher et al.

[11] 4,344,307

[45] Aug. 17, 1982

[54] THREAD CONTROL MEANS IN A TEXTILE MACHINE

[75] Inventors: Robert R. Bucher; Felix Riner, both of Frick, Switzerland

[73] Assignee: Textilma AG, Switzerland

[21] Appl. No.: 168,662

[22] Filed: Jul. 11, 1980

[30] Foreign Application Priority Data

Jul. 12, 1979 [CH] Switzerland ..... 6497/79

[51] Int. Cl.[3] ..... D04B 23/06

[52] U.S. Cl. ..... 66/84 R; 66/207; 66/126 R

[58] Field of Search ..... 66/203, 204, 84 R, 84 A, 66/126 R

[56] References Cited

U.S. PATENT DOCUMENTS 3,258,942 7/1966 Mednick ..... 66/193
4,034,579 7/1977 Tillon ..... 66/193

FOREIGN PATENT DOCUMENTS 2721024 10/1977 Fed. Rep. of Germany ..... 66/84 A

*Primary Examiner*—Ronald Feldbaum
*Attorney, Agent, or Firm*—McGlew and Tuttle

[57] ABSTRACT

A thread control device of a weft knitting machine comprises a thread guide, which is fastened to a weft rod. The weft rod is mounted to be pivotable about its longitudinal axis and to be axially displaceable in supports, which in turn are movable at right angles to the axis. The weft rod is connected to be secure against rotation with a non-axially displaceable crank. A non-rotatable drive transfer member is reciprocatingly displaceable in a plane parallel to the axis by, for example, a pivot arm. A thrust member is articulated by ball joints to the crank and to the transfer member and in operation converts reciprocating motion of the transfer member into oscillatory pivotation of the crank. Such a thread control device makes high operating speeds possible and enables production of tapes with complicated patterns. The pivotation can be produced and controlled by a dog chain guided over a cylinder, which can guide other dog chains for displacement of additional weft rods and the axis of which extends at right angles to the weft rods.

18 Claims, 11 Drawing Figures

Fig.1
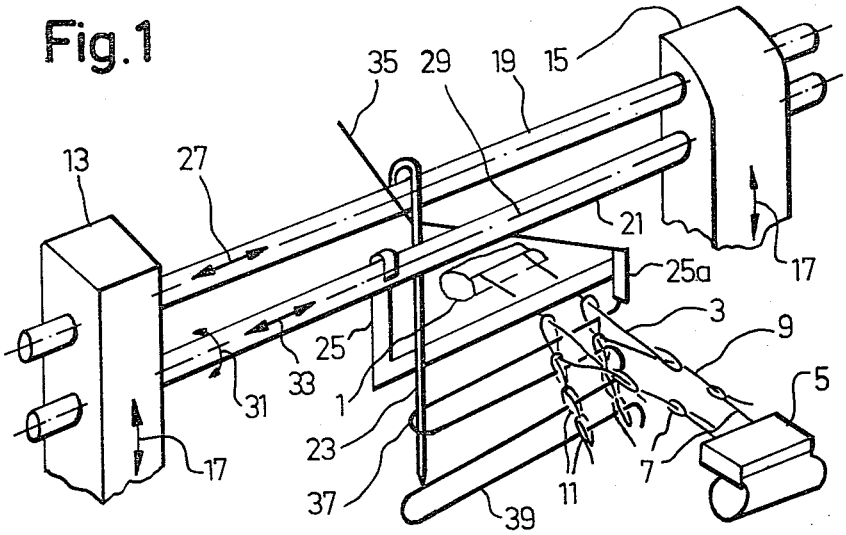
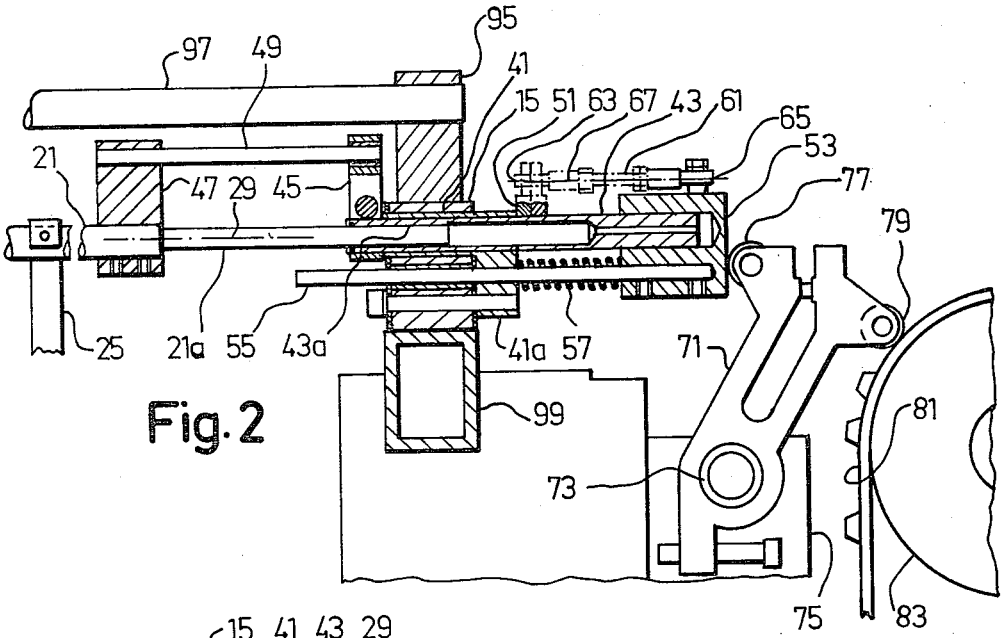
Fig.2
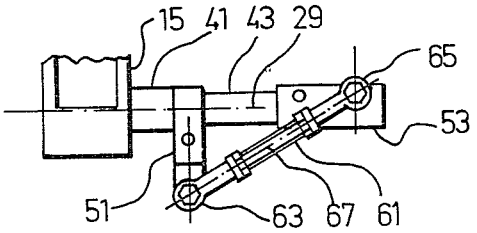
Fig.3

Fig. 4
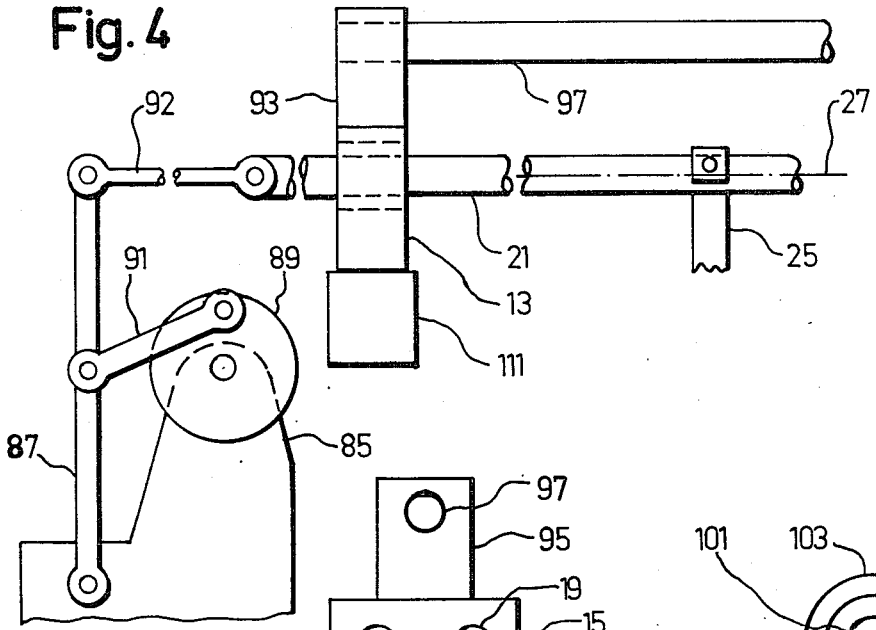
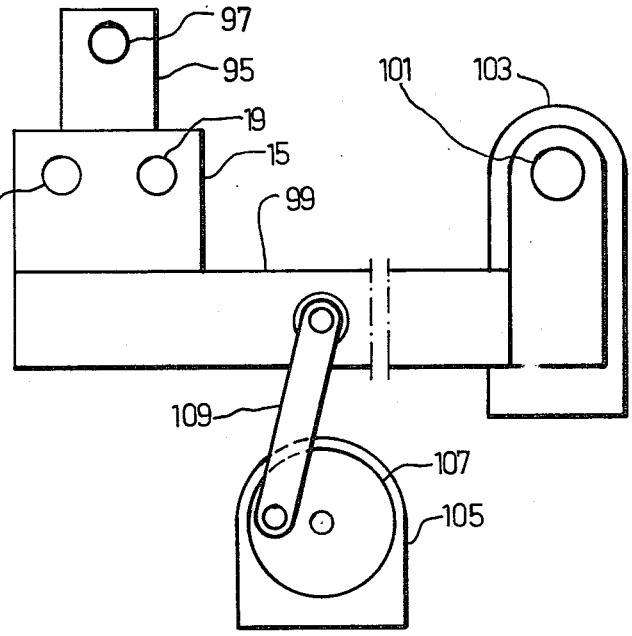
Fig. 5
Fig. 6
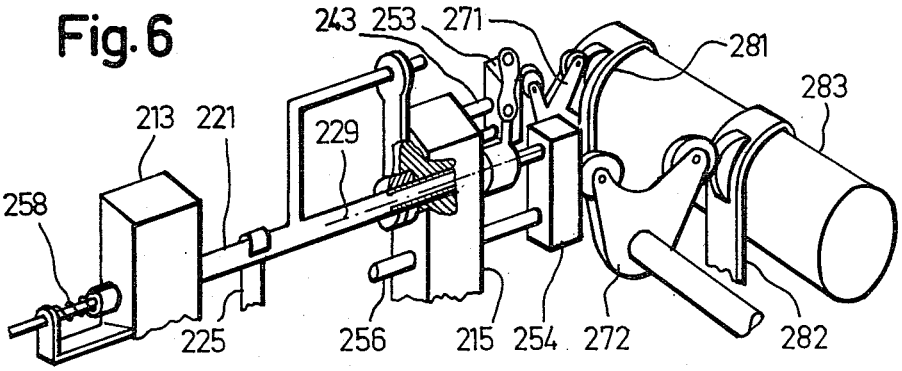

Fig. 9
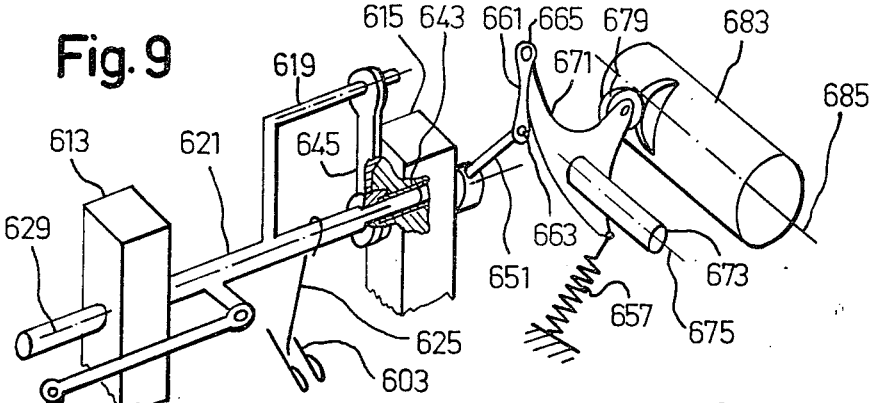
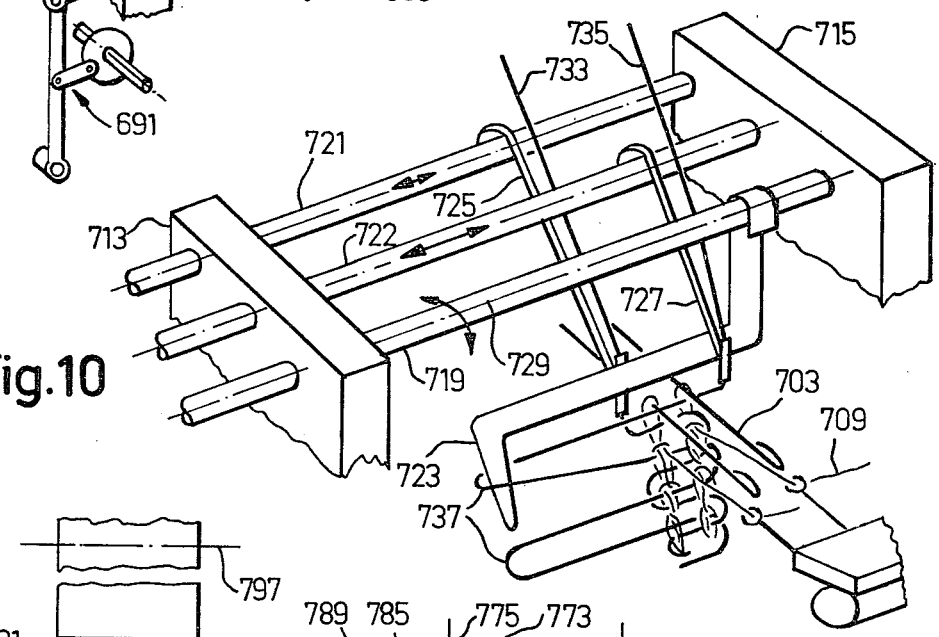
Fig. 10
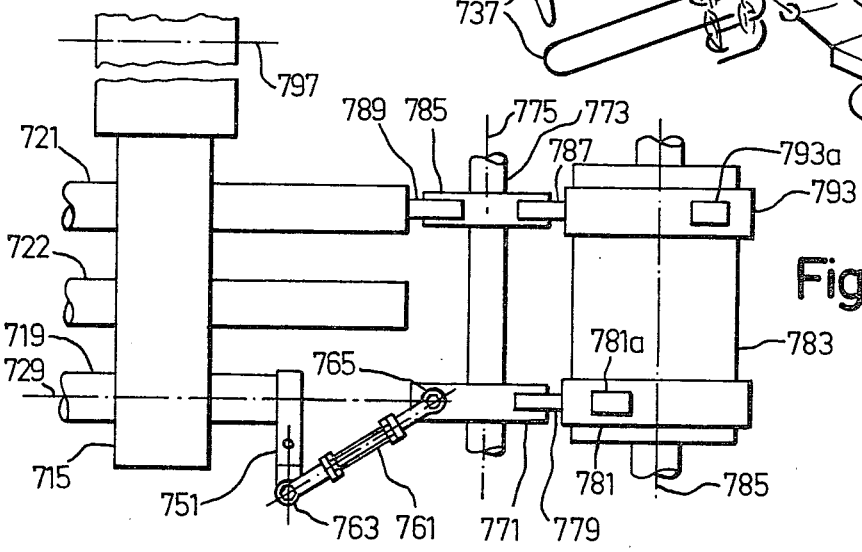
Fig. 11

THREAD CONTROL MEANS IN A TEXTILE MACHINE

BACKGROUND OF THE INVENTION

The present invention relates to thread control means in a textile machine.

In German (Fed. Rep.) published patent specification No. 27 58 421 there is disclosed a weft knitting machine having at least one weft rod with a thread guide fastened thereto. The, or each such weft rod is guided at each end thereof to be displaceable in a support. A pivot arm, which is pivotably mounted on a machine frame and pivoted by a dog plate, engages the weft rod and in operation reciprocates the weft rod along its longitudinal axis. In this manner, a weft thread guided in the thread guide can be laid out transversely to the hook needles and warp threads in the machine so that it interconnects the stitches formed by the different warp threads. The supports with the weft rod or rods are, in operation, moved to and fro at right angles to the weft rod axis and approximately at right angles to the hook needles.

For the production of knit goods with fringes or laces, the weft thread guide should in addition be pivotable about the axis of the weft rod to which it is fastened. In the weft knitting machine disclosed in the above-mentioned German patent specification, there is no provision for pivotation.

In the book "Die Häkelgalonmaschine" by R. Büttner (Eugen G. Leuze Verlag, Saulgau Württemberg) there is described a braid-crocheting machine with a reflex turner by which it is possible to pivot a weft rod to and fro about its axis. This turner has a drive crank with a shaft parallel to the weft rod. The drive crank is connected by a rod with a crank which is mounted in a support serving for guidance of the weft rod. The movement of the crank is transmitted through a ratchet wheel to a cylinder, which is provided with detachable dogs arranged in accordance with the pattern to be produced. The dogs are scanned by a feeler lever which is mounted in the support to be pivotable about a pivot axis extending parallel to the weft rod. The feeler lever, together with an additional lever, retains the rod to which the thread guide is fastened.

This turner does, however, have a number of disadvantages. Due to its complicated construction, it only allows low operating speeds. Moreover, only relatively simple patterns can be produced, because the dog cylinder, which is moved along with the support, cannot be made as large as desired. It is also not possible to control the pivotal motion of the thread guide by the same dog cylinder, or by dog chains of like kind used for controlling the reciprocating displacement of the weft rod or rods.

There is also described in "Die Häkelgelonmaschine" a machine in which a bracket forming a cam is fastened to a longitudinally displaceable weft rod. An arm is fastened to an axially non-displaceable rod to be pivoted, which extends transversely to this rod and is provided with a feeler roller. The roller follows the cam and is held thereagainst by a spring acting on the arm. The weft rod provided with the bracket can be displaced in its longitudinal direction by a Jacquard pull. This displacement then effects, through the bracket and the arm, a pivotation of the rod to be pivoted.

The machine has the disadvantage that the pivotable rod can be pivoted but not axially displaced. Furthermore, one of the weft rods, namely the weft rod provided with the bracket, is used exclusively for converting a linear displacement motion into a pivotal motion. Since braid-crocheting machines for reason of space, among other reasons, can usually only be equipped with a relatively small number of weft rods, for example about six weft rods, the possibilities for formation of patterns are greatly restricted when one of the weft rods is exclusively pivotable and another of the weft rods has to be used to generate this pivotation. Moreover, it is not possible with the previously known reflex turner to vary the magnitude of the pivotation according to a predetermined program, which further restricts the scope for formation of patterns. Furthermore, the known turner only permits relatively low operating speeds.

A device for the pivotation of the thread guide rod of a braid-crocheting machine is also disclosed in German (Fed. Rep.) patent specification No. 542 184. The thread guide rod is pivotably mounted in bearings. A slide is guided at one end of the thread guide rod to be displaceable therealong. The thread guide rod is secured against axial displacement by two setting rings firmly clamped thereto. One of these setting rings is provided with a pin which projects into a bevelled slot of a strap fastened to the slide. The slide and the strap can be displaced by Jacquard chain pins. Because the slot in the strap is bevelled, the pin is laterally deflected on displacement of the slide and strap. The pin and the setting ring, to which the pin is fastened, thus together from a crank which converts the axial reciprocating movement of the slide and strap into pivotal movement of the thread guide rod. The strap is additionally secured to the slide to be radially adjustable with respect to the axis of the thread guide rod.

On displacement of the slide, the pin is not only deflected laterally, but also changes its angle of inclination with respect to the strap. The pin must therefore be guided in the strap with a relatively large amount of play. This is particularly so because the strap is after all, radially displaceable relative to the thread guide rod. Furthermore, the pin in at least part of its range of settings bears against the strap at only one point. This has the disadvantage that operation is possible only with relatively low frequencies of pivotation and that wear is relatively high. Moreover, the angle of pivotation must be kept relatively small, otherwise the above-mentioned play must be increased, and the thread guide rod is not axially displaceable.

The present invention therefore has the task of providing a thread control means in which a thread guide means, including a thread-deflecting means, can be pivotable around a pivot axis at a high cyclic frequency even with complicated pattern programs. Furthermore, it should be possible, if required, to additionally displace the thread guide to and fro along the pivot axis and independently of the pivotation.

SUMMARY OF THE INVENTION

According to one aspect of the present invention there is provided, in a machine for producing textile material, a thread control means comprising thread guide means mounted for pivotation about a pivot axis, a crank operatively connected to said thread guide means to be pivotable therewith about said pivot axis but restrained against movement parallel to said axis, drive transmission means mounted for reciprocating motion in a plane parallel to said pivot axis, and connecting means so connecting said drive transmission means to said crank as to convert said reciprocating motion of said drive transmission means into oscillatory pivotation of said crank and thereby of said thread guide means about said pivot axis, said connecting means comprising a link element, a first pivot joint connecting said link element to said crank and a second pivot joint connecting said link element to said drive transmission means, said pivot joints being arranged to permit pivotation of said link element relative to said crank and drive transmission means in three dimensions and being disposed on a straight line which extends at an inclination relative to said axis.

Such thread control means are particularly suitable for the laying-out or deflection of a weft thread in a weft knitting machine, for example a braid-crocheting machine, wherein the thread guide means is carried by a weft rod.

The pivotation of such a weft rod can be produced and controlled by drive means of like kind to that used for the parallel displacement of the weft rod. The pivotation and parallel displacement can be produced by, for example, dog chains and levers which scan the dogs of the chains and are pivotably mounted in a frame of the machine, wherein all such dog chains may be guided around a common cylinder and all levers pivotable about a common pivot axis. In accordance with the kind of knitted goods to be produced, dog shafts, dog discs or cam discs can be employed in place of the dog chains.

Thread control means embodying the invention can, however, be used in other types of machines for the production of textile sheet materials in which a thread guide means must be pivoted about a pivot axis in a predetermined manner.

In accordance with another aspect of the invention there is provided a method of operating a thread control means according to said one aspect of the invention, the method comprising reciprocatingly moving said drive transmission means in said plane parallel to said pivot axis thereby to cause said connecting means to effect oscillatory pivotation of said crank and thereby of said thread guide means about said pivot axis.

While specific embodiments of the invention have been shown and described in detail to illustrate the application of the principles of the invention, it will be understood that the invention may be embodied otherwise without departing from such principles.

BRIEF DESCRIPTION OF THE DRAWINGS

Embodiments of the present invention will now be more particularly described by way of example with reference to the accompanying drawings, in which:

FIG. 1 is a schematic perspective view of a part of a braid-crocheting machine according to one embodiment of the invention, FIG. 2 is a sectional elevation of drive means for pivoting a weft rod in the machine of FIG. 1, FIG. 3 is a plan view of part of the drive means of FIG. 2, FIG. 4 is a schematic elevation of a drive device for reciprocation of said weft rod, FIG. 5 is a schematic elevation of a drive device for reciprocating a weft rod support in the machine of FIG. 1, FIG. 6 is a schematic partly broken-away perspective view of a braid-crocheting machine according to another embodiment of the invention, FIG. 9 is a schematic partly broken-away perspective view of a modified drive device for pivotation of a weft rod in a machine embodying the invention, FIG. 10 is a schematic plan view of the weft rods of a braid-crocheting machine according to yet another embodiment of the invention, one of the rods carrying a pivotable thread-deflecting pin, and FIG. 11 is a schematic plan view of drive means for pivotation and axial displacement of the weft rods shown in FIG. 10.

DESCRIPTION OF THE PREFERRED EMBODIMENTS

Figure 7:
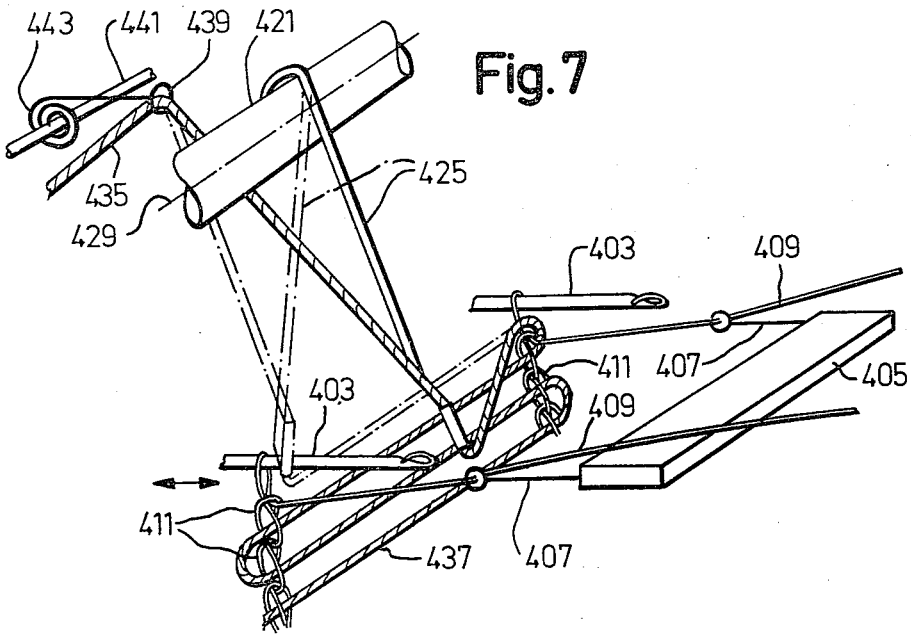
FIG. 7 is a schematic perspective view of a thread guide of a machine embodying the invention, the thread guide being selectably positionable to effect different dispositions of a thread.

Referring now to the drawings, in FIG. 1 there is shown part of a weft knitting machine, in particular a braid-crocheting machine, having a needle bed 1, of which only a part is illustrated. The needle bed holds crochet needles 3 which are arranged alongside one another and extend parallel to each other. The needle bed 1 is movably mounted in such a manner in a machine frame (not shown) that it is reciprocatingly displaceable by a drive device and in the longitudinal direction of the needles 3. The machine also has a holder 5 provided with a respective thread slide elment 7, in the form of an apertured needle, for each of the needles 3. The holder 5 is movably mounted in the machine frame and connected with drive means in such a manner that each thread guide element 7 in operation describes an endless locus about the longitudinal axis of the associated needle 3. Each thread guide element 7 guides a weft thread 9 from which, in operation, successive stitches 11 are formed in known manner.

Two supports 13 and 15 each with a respective pivot arm are pivotably mounted in the frame in pivot bearing in such a manner that they can, in operation, be moved along a circular arc by a drive device. The pivot bearings are arranged so that the portions of the supports evident in FIG. 1 execute a reciprocating vertical movement substantially perpendicularly to the longitudinal axis of the needles 3, as indicated by the arrows 17.

At least one weft rod is mounted in two supports 13 and 15 to be axially displaceable, and in the embodiment of FIG. 1 two such weft rods 19 and 21 are so mounted. The weft rod 19, to which a thread-deflecting pin 23 is secured, is only capable of reciprocating axial displacement, as indicated by the arrow 27. However, the weft rod 21, to which a thread guide 25 with a guide sleeve **25*a* is secured, can be oscillatingly pivoted about its longitudinal axis, which constitutes a pivot axis 29 for the thread guide 25, and also reciprocatingly displaced along the axis 29. These two movements of the thread guide 25 are indicated by the arrows 31 and 33**.

In operation, a weft thread 35 is guided through the guide sleeve **25*a* of the thread guide 25. The weft rod 21 is displaced to and fro synchronously with the movements of the needles 3, the thread guide elements 7 and the supports 13 and 15 in such a manner that the weft thread is laid into the stitch formations being produced and thereafter interconnects adjacent stitches 11** of the formations.

When the thread guide 25 in FIG. 1 is disposed in an end position on the lefthand side of the thread-deflecting pin 23, the thread guide 25 can be so pivoted around the axis 29 that it moves from the front side of the pin 23 to the rear side thereof or vice versa. When such pivotations are effected between axial displacements of the thread guide 25, the weft thread 35 is laid around the pin 23. As a result, loops 37 and 39 are formed, which project beyond the stitch formation at one edge of the tape material being produced. When the weft rod 19 with the thread-deflecting pin 23 is then axially displaced, loops of variable size can be produced. In the present case, the loop 37 is, for example, shorter than the loop 39.

The thread guide 25 together with the associated drive elements thus forms a reflex turner.

The loops 37 and 39 can form laces or fringes in the finished tape, for which purpose they can be cut open before finishing of the tape.

Further weft rods with thread guides can of course be provided, so that weft threads of different colours and/or thicknesses can be incorporated in the tape. The axial displacement of the weft rods 19 and 21 and the pivotal movement of the weft rod 21 can be controlled by a program carrier in accordance with a predetermined program, so that patterns of different kinds can be formed.

The detailed construction of the weft rod 21 and of the means provided for driving same will now be explained with reference to FIGS. 2 to 5. It is mentioned that the non-pivotable weft rod 19 and other parts have, for reasons of clarity and simplification, been omitted from FIGS. 2 to 5.

Inserted in the support 15 is a bearing bush 41, which on the right-hand side of the support 15 in FIG. 2 has a downwardly projecting plate 41*a* firmly secured by a screw to the support 15. A sleeve 43 is rotatably mounted in the bore of the bush 41, and in the bore 43*a* of the sleeve 43 an end portion 21*a* of the weft rod 21 is so engaged that the rod 21 is slidable in the bore 43*a*, whereby the rod 21 is displaced in the direction of its axis 29. It is to be noted that the end portion 21*a* is somewhat thinner than the rest of the weft rod 21, although for simplification the weft rod was drawn in FIG. 1 to be of constant thickness.

At the end of the sleeve 43 projecting out on the lefthand side of the support 15 in FIG. 2 there is arranged an arm 45 which is secured against rotation and axial displacement by a clamping screw. Even further to the left, an arm 47 is fastened to the weft rod 21 to be secure against rotation and axial displacement. A rod 49 extending parallel to the weft rod 21 is secured to the arm 47 and guided to be axially displaceable in the arm 45, the rod 49 connecting the weft rod 21 to the sleeve 43 to be secure against relative rotation.

A crank 51 is fastened, to be secure against rotation and axial displacement, to the sleeve 43 on the right-hand side of the support 15 in FIG. 2. The end faces of the bush 41 form abutments for the arm 45 and the crank 51 so that the sleeve 43, the arm 45 and the crank 51, apart from perhaps a small amount of play, are retained in the support 15 to be axially non-displaceable.

A drive transmission or transfer member 53 is mounted to be displaceable along the pivot axis 29 on the righthand end of the sleeve 43 in FIG. 2. Fastened to the transfer member 53 is a pin 55, which extends parallelly to the weft rod 21 and is slidably engaged in bores of the support 15 and plate 41*a*. The pin 55 secures the transfer member 53 against rotation about the pivot axis 29. A spring 57 arranged on the pin urges the transfer member 53 away from the support 15.

A thrust member 61, comprising a threaded rod and adjusting nuts which serve for length adjustment, is connected through a ball joint 63 with the crank 51 and through a ball joint 65 with the transfer member 53. A straight line 67, which forms the longitudinal axis of the thrust member 61 and passes through the centres of the two ball joints 63 and 65, extends askew to the pivot axis 29.

A pivot arm 71 is mounted by means of a pivot pin 73 on a part 75 of the machine frame to be pivotable about a pivot axis extending at right angles to the pivot axis 29. The pivot arm 71 is provided with a roller 77 having a running surface which bears against an end face of the transfer member 53 extending at right angles to the pivot axis 29. The pivot arm 71 is also provided with a follower roller 79, which runs on a dog chain 81 guided on a cylinder 83 rotatably mounted in the machine frame.

With reference to FIG. 4, a pivot arm 87 and a crank disc 89 are mounted on a part 85 of the machine frame. The pivot arm 87 and the crank disc 89 are connected with one another through a connecting rod 91. The pivot arm 87 is coupled by a rod 92 to the weft rod 21 in such a manner that it can displace rod 21 without preventing pivotion thereof.

Two holders 93 and 95 are fastened to the tops of the two supports 13 and 15 respectively, the holders being rigidly interconnected by a rod 97. The support 15 is fastened to a pivot arm 99 shown more clearly in FIG. 5. The arm 99 is pivotably mounted in a part 103 of the frame by means of a pivot bearing 101. The pivot axis of the pivot bearing 101 extends parallelly to the weft rods 19 and 21 as well as to the pivot axis 29. The axis 29 and the pivot axis of the pivot bearing 101, in the mid-position of the pivot arm 99, lie in a plane which extends approximately parallel to the plane spanned by the needles 3. This ensures that the weft rod 21 and the pivot axis 29 during pivotation are pivoted through a circular arc which extends substantially at right angles to the needles 3. A crank disc 107 rotatably mounted in the frame part 105 is connected by a connecting rod 109 with the pivot arm 99.

The support 13 is fastened to a pivot arm 111, which is pivotably mounted in a manner analogous to that of the pivot arm 99 and either rigidly connected therewith or with a separate crank disc.

In operation of the machine, the crank disc 107—serving as a drive means—and the optionally additional crank disc connected to the pivot arm 111, rotate so that the two supports 13 and 15, as already mentioned in connection with FIG. 1, are pivoted up and down synchronously with the movement of the needles 3. In addition, the crank disc 89, also serving as a drive means, is also rotated synchronously with the movement of the needles and the weft rod 21 is correspondingly axially displaced to and fro.

At the same time, the dog chain 81 is continuously moved by means of the cylinder 83 or other drive device. When the pivot arm 71 is pivoted by a dog of the dog chain 81, the pivot arm 71 pushes the transfer member 53 to the left in FIGS. 2 and 3. The thrust member 61, which is connected to the crank 51 and transfer member 53 to be pivotable in three dimensions, in that case pivots the crank 51 about the pivot axis 29. This pivotal movement is then transferred through the sleeve 43, the arms 45 and 47 and the rod 49 to the weft rod 21 and to the thread guide 25 fastened to the rod 21. The dog chain 81 is, of course, driven in such a manner that the pivotation of the thread guide 25 takes place synchronously with movement of the needles 3 into a predetermined position.

The two ball joints 63 and 65 are arranged in such a manner, and the length of the thrust member 61 is so related to the stroke of the transfer member 53, that the line 67 passing through both the ball joint centers always extends askew to the pivot axis 29 irrespective of the setting of the thrust member 61. This ensures that the thrust member 61 does not have a dead center position in which it resists the movement of the transfer member 53.

Since the roller 77 bears against a surface of the transfer member 53 which extends parallel to the direction of movement of the support 15, the movement of the support does not have the consequence of effecting an axial displacement of the transfer member 53 which would result in pivotation of the thread guide 25. The pivotation of the thread guide 25 around the pivot axis 29 can therefore take place quite independently of the movement of the support 15.

It will, however, be appreciated that it would be quite possible to dispense with a transfer member displaceable parallel to the pivot axis 29, as will now be explained by reference to the embodiments illustrated in FIGS. 6 to 11. The thrust member could, for example, be articulated by a ball joint directly to a pivot arm, which corresponds to the pivot arm 71 and which would be movable, i.e. pivotable, in a plane parallel to the pivot axis 29. This pivot arm, connected through the thrust member with a crank corresponding to the crank 51, would at the same time then have the function of the transfer member. Although the pivotation of the thread guide would then no longer be completely decoupled from the movement of the supports, it would be possible through suitable construction of the different components for the movement of the supports to have virtually only negligible effect on the pivotation of the thread guide.

When a tape is to be produced with fringes or laces of different lengths, as was mentioned in the discussion of FIG. 1, the rod 19 can, for example, be displaced by a cam disc or by a dog chain with dogs of different heights. Such a dog chain could be guided by the same cylinder 83 as the dog chain 81.

It is, however, possible to guide the dog chains serving for displacement of the weft rods and the dog chain serving for pivotation of the weft rod parallel alongside one another around the same cylinder and to derive drive therefrom at this cylinder. A modification along these lines is illustrated in FIG. 6, which shows only a single weft rod, namely a weft rod 221, which is part of the reflux turner and to which a thread guide 225 is fastened. In an analogous manner to the weft rod 21, the weft rod 221 is movably mounted in two supports 213 and 215. Two dog chains 281 and 282 are guided on a cylinder 283, the dog chain 281 being engaged by a pivot arm 271. A transfer member 253 serving for imparting reciprocating motion, is mounted to be displaceable along a guide pin 243, the axle of which, through running parallel to the pivot axis 229, is not aligned with it. Apart from this difference, the pivotal movements of the pivot arm 271 are converted, in a manner analogous to that in the embodiment of FIGS. 1 to 5, into oscillatory pivotation of the thread guide 225 about the pivot axis 229. A pivot arm 272, which engages a dog chain 282, serves for displacement of the weft rod 221 and engages a transfer member 254. The weft rod 221 is connected to the member 254 to be axially displaceable therewith but rotatable relative thereto, the transfer member 254 being secured against rotation by a pin 256. A spring 258 acts on a collar on the weft rod 221 and on part of a support 213 and urges the weft rod 221 and transfer member 254 against the pivot arm 272 and the arm 272 against the dog chain 282.

When a number of weft rods are provided, additional dog chains can of course be guided around the cylinder 283 to provide the appropriate drive functions.

FIG. 7 shows a modification of a braid-crocheting machine which enables selectable disposition of a thread into or around stitches. The thread control means serving this task comprises crochet needles 403 and a holder 405 to which thread guide elements 407 are fastened. A stitch formation with stitches 411 can be knitted from a warp thread 409 by pairs of mutually associated needles 403 and thread guide elements 407. The control means includes a weft rod 421 to which a thread guide 425 is fastened and which is pivotable about and axially displaceable along a pivot axis 429 in the manner illustrated in FIGS. 1 to 5 by drive and drive transfer means. The thread guide 425 guides a weft thread 435 which is fed to the thread guide 425 through a thread tensioner 439 held by a coil spring 443, the spring 443 being secured to a rod 441.

In operation of the control means illustrated in FIG. 7, the weft rod 421 is periodically reciprocatingly displaced transversely to the stitch formations by a crank drive so that the thread guide 425 is moved past both the stitch formations. In that case, a displacement takes place during production of each stitch. The weft rod 421 can be selectably moved into either one of two pivotal settings by means of a dog chain corresponding to the dog chain 81. In one of these settings, the thread guide 425 and the weft thread 435 assume the position indicated in chain-dotted lines. In this position, the weft thread 435 is laid into the stitches of both the stitch formations so that during the relevant displacement of the thread guide 425 a thread section 437 is formed to interconnect the two stitch formations. On the other hand, when the thread guide 425 is disposed in the pivotal position illustrated in solid lines, it moves during displacement past the stitch formations at such a spacing that the thread 435 is not laid into the stitches. The thread tensioner 439 held by the spring 443 draws the thread section back, which is laid out during such an "idle" displacement but not laid into the stitches, each time so that the weft thread always remains tensioned.

As is evident from the preceding description, the thread guide is also periodically reciprocatingly axially displaced by the crank drive independently of whether or not the weft thread 435 is laid into the stitches. The axial displacements, which can be relatively long, thus take place during each operating cycle and need not be controlled. The pivotations, by which it is determined whether the weft thread is laid in or not, can be produced by relatively low dogs of a dog chain. If on the other hand a dog chain with dogs for the displacement of the weft rod was used, these dogs would have to have a height corresponding to the displacement path, which would mean restriction to low operating speeds.

Figure 8:
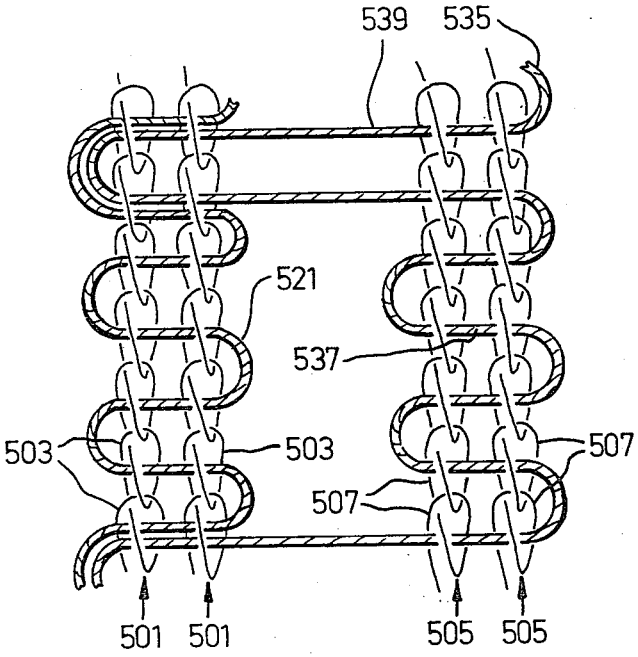
FIG. 8 is a plan view of a curtain tape produced by a machine embodying the invention.

The tape material shown in FIG. 8 comprises two parallel pairs 501 and 505 of stitch formations with stitches 503 and 507. The two stitch formations of the pair 501 are relatively close together, as are the formations of the pair 505, while the spacing between the pairs themselves is much greater. A weft thread 521 is laid into the stitches 503 of the two stitch formations 501 and a weft thread 535 is laid into the stitches 507 of the two stitch formations 505. The weft thread 535 at certain spacings has sections 539 which are additionally laid into stitches 503 of the stitch formations 501 as to form loops connecting the stitch formations 501 with the stitch formations 505. Disposed between the sections 535 forming the limbs of a loop are a few stitches in a region where the two stitch formations are not connected together.

The tape shown in FIG. 8 can together with other identical tapes, be used for the formation of a laminate curtain, the laminae of which are held between the loops formed by the thread sections 539.

The tape shown in FIG. 8 can be produced by a braid-crocheting machine which, inter alia, has thread control means of the kind illustrated in FIG. 7, but four needles and an additional weft rod with a respective thread guide. The thread guide serving for the laying-in of the weft thread 521 is periodically displaced to and fro without pivotation. For the laying-in of the weft thread 535, a thread guide is used which is axially displaceable and pivotable in like manner to the thread guide 425. This thread guide is displaced transversely to the stitch formations in such a manner that it moves past all four stitch formations during production of each loop. The thread guide is then so pivoted each time that the weft thread 535 is laid into all the stitches 507 of the two stitch formations 505 but only into certain stitches of the stitch formations 501.

In FIG. 9 there is shown thread control means comprising a series of crochet needles 603 (only some of which are illustrated) and two supports 613 and 615, which can be pivoted up and down around a pivot axis analogously to the support 13 and 15 as explained in connection with FIG. 5. A number of weft rods are displaceably guided in both supports. For simplicity, the only one shown is a weft rod 621 which is not only axially displaceable but also pivotable about a pivot axis 629 coinciding with its longitudinal axis and to which at least one thread guide 625 is fastened.

A sleeve 643 is mounted in the support 615 to be pivotable about the pivot axis 629 but secured against axial displacement. The weft rod 621 is in turn axially displaceable in the sleeve 643. An arm 645 is fastened, secure against rotation, to the end of the sleeve 643 on the lefthand side of the support 615. A cranked rod 619 is slidably engaged in the free end of the arm 645 to be displaceable parallelly to the pivot axis 629 and connects the weft rod 629 to be secure against rotation, but axially displaceable relative to the sleeve 643. On the righthand side of the support 615 there is arranged a crank 651 which is rigidly fastened to the sleeve 643, i.e. it is secure against rotationa as well as non-displaceable along the pivot axis 629. A lever 671 is pivotably mounted in the frame by means of a bearing pin 673, the axis 675 of which extends at right angles to the pivot axis 629. The lever 671 has a follower roller 679 and, under the influence of a spring 657, bears against a dog shaft 683, which is rotatable about a rotational axis 685 extending at right angles to the pivot axis 629. A rigid, rod-shaped thrust member 661 is connected at one end by a ball joint 663 with the crank 651 and at the other end by a ball joint 665 with the lever 671.

In operation, the lever 671 is oscillatingly pivoted about the axis 675 by the dogs of the continuously rotating dog shaft 683. These pivotal movements of the lever 671 are transferred by the thrust member 661 to the crank 651 and thereby pivot the weft rod 621 and thread guide 625 fastened thereto about the pivot axis 629. In addition, the weft rod 629 can be reciprocatingly axially displaced by the crank drive indicated generally by 691.

In FIGS. 10 and 11 there is shown part of a braid-crocheting machine with crochet meedles 703 and two supports 713 and 715. A weft rod 719, to which at least one thread-deflecting element 723—a so-called pricker or claw—is fastened, is guided in the support 713 and 715 to be pivotable about a pivot axis 729, but non-axially displaceable. Two weft rods 721 and 722, to which two thread guide elements 725 and 727 are fastened respectively, are guided in the two supports to be displaceable parallel to the pivot axis 729.

A cylinder 783 is journalled in the frame to be rotatable about a rotational axis 785 extending at right angles to the pivot axis 729. Guided on this cylinder are a dog chain 781 with dogs **781*a* allocated to the weft rod 719 and a dog chain 793 with dogs 793*a* allocated to the weft rod 721. Also fastened in the frame is a bearing rod 773, the axis 775 of which extends at right angles to the pivot axis 729. A first lever 771 with a follower roller 779 engaging the dog chain 781 is pivotably mounted on the bearing rod 773. A thrust member 761 is connected at one end by a ball joint 763 with a crank 751 and at the other end by a ball joint 765 with the first lever 771. The crank 751 is connected with the weft rod 719 to be secure against rotation relative thereto and to be non-displaceable along the pivot axis 729. In addition, a second lever 785 is pivotably mounted on the bearing rod 723. This second lever is provided with a follower roller 787, which engages the dog chain 793, and a roller 789, which engages the weft rod 721. Also provided are a spring (not shown) corresponding to the spring 657 and engaging the lever 771 and a spring urging the weft rod 721 against the second lever. For axial displacement of the weft rod 722, a crank drive of, for example, the kind shown in FIG. 4** is provided.

The two supports 713 and 715 are mounted in the frame to be pivotable about an axis 797 and can be pivoted up and down synchronously with the needle movement by a drive device which corresponds to the drive device illustrated in FIG. 5.

In operation of the machine shown in FIGS. 10 and 11, stitch formations are produced from warp threads 709. At the same time, the two weft rods 721 and 722 are reciprocatingly axially displaced so that their thread guides lay a respective weft thread 733 or 735 into the stitches. The axial displacement of the weft rod 722 is greater than that of the weft rod 721. The thread-deflecting element 723 can be pivoted about the pivot axis 729 by the dog chain 781 through the lever 771, which serves as transfer member and thrust member. When for example, a dog of the dog chain 781 is so positioned that a pivotation takes place while the thread guide 727 is disposed to the left of the thread-deflecting element 723, the latter can grip and hold back the weft thread 735 so as to form a loop 737, which protrudes over one edge of the textile material being produced. In accordance with how the pivotations of the thread-deflecting element 723 are controlled by the dog chain 781, loops are formed during all reciprocating axial displacements of the thread guide 727 or during only a part of these displacements.

In both the control means illustrated in FIGS. 9 to 11, the levers 671 and 771, respectively, constitute the transfer member, which, under the control of the dog shaft 683 or the dog chain 781, is moved to and fro along a plane extending through the pivot axis 629 or 729. These reciprocating movements of the levers are then converted through the thrust member 661 or 761 into pivotation of the weft rod 621 or 721. As mentioned, the supports 613 and 615 or 713 and 715 are additionally pivoted up and down about axes which are parallel to the weft rods.

In order that the movements of the supports 713 and 715 cause the smallest possible pivotation of the weft rod 719, the ball joints 763 and 765 of the control means shown in FIGS. 10 and 11 are arranged in such a manner that their centers in one setting of the thrust member 761 both lie in a plane which runs through the axis 797 about which the supports are pivoted. Otherwise, the straight line extending through the two ball joint centers is askew to the pivot axis 729. The ball joints 663 and 665 of the control means illustrated in FIG. 9 are arranged analogously.

It will be readily apparent that the thread control means hereinbefore described can be modified within the scope of the invention as defined in the appended claims and that different combinations of the individual features of the several embodiments can be formulated.

In particular, the number of the weft rods and the number of the thread guides, including thread-deflecting members fastened thereto can be varied according to the kind of knitted goods or other material to be produced. In addition, the displacements of the weft rods can be produced by crank drives, cam or dog discs or dog chains in accordance with the necessary magnitude of the stroke and the kind of patterns to be produced. These crank drives, cam or dog discs or dog chains then simultaneously serve as drive means and program carriers in order to control the course of motion according to a predetermined program.

When dogs of different heights or correspondingly shaped cam discs are provided, then during the production of a fabric it is readily possible to also vary the magnitude of the pivotations of the pivotable weft rod according to a preselected program.

In the described embodiments, the thrust member is connected through respective ball joints with the transfer member and the crank. It would, however, be possible to replace each ball joint by a self-aligning ball bearing which also permits three-dimensional pivotations within a certain angular range. Moreover, each ball joint could be replaced by a joint which consists of two partial joints each having a respective pivot axis. The two pivot axes could in that case either cross each other as in a carbon suspension or extend askew to each other. In the latter case, the spacing of the pivot axes of the same joint should be smaller than the length of the thrust member or, stated more exactly, smaller than the spacing of the two joints. In that case, the two joints, in particular their centers, should preferably lie on a straight line which in every possible setting of the thrust member extends askew to the thread guide pivot axis. To be understood by the centers of a joint is that point which lies in the centers of the shortest line connecting the two pivot axes of the same joint.

We claim:

1. In a machine for producing textile material, a thread control means comprising thread guide device mounted for pivotation about a pivot axis, a crank operatively connected to said thread guide means to be pivotable therewith about said pivot axis but restrained against movement parallel to said axis, drive transmission means mounted for reciprocating motion in a plane parallel to said pivot axis, and connecting means so connecting said drive transmission means to said crank as to convert said reciprocating motion of said drive transmission means into oscillatory pivotation of said crank and thereby of said thread guide means about said pivot axis, said connecting means comprising a link element, a first pivot joint connecting said link element to said crank and a second pivot joint connecting said link element to said drive transmission means, said pivot joints being arranged to permit pivotation of said link element relative to said crank and drive transmission means in three dimensions and being disposed on a straight line which extends at an inclination relative to said axis.

2. Thread control device according to claim 1, wherein each of said pivot joints is constructed as a ball joint.

3. Thread control device according to claim 1, wherein each of said pivot joints is constructed as a self-aligning bearing.

4. Thread control device according to claim 1, wherein said drive transmission means is guided to be rectilinearly displaceable parallel to said pivot axis and is constrained against rotation.

5. Thread control device according to claim 4, comprising support means supporting said thread guide means and mounted to be displaceable in a direction extending substantially perpendicularly to said pivot axis, and a drive member in driving engagement with a surface of said drive transmission means for imparting reciprocating motion thereto, said surface extending substantially perpendicularly to said pivot axis thereby to maintain engagement with said drive member during said displacement of said support means.

6. Thread control device according to claim 1, wherein said drive transmission means comprises means mounted to be pivotable about a further pivot axis extending substantially perpendicularly to said pivot axis of the thread guide means, said reciprocating motion of said drive transmission means consisting of or being derived from reciprocating pivotation of said means about said further pivot axis.

7. Thread control device according to claim 6, comprising an axially displaceable weft rod for carrying weft thread guide means, a drive member drivingly coupled to said weft rod for axially displacing the rod and mounted to be pivotable about said further pivot axis, and cam drive means movable around a single axis to impart pivotal movement to both of said drive member and said means of said drive transmission means.

8. Thread control device according to claim 1, comprising support means, and a weft rod displaceably mounted in said support means and operatively connected to said crank to be pivotable therewith, said thread guide means being secured to said weft rod.

9. Thread control device according to claim 8, wherein said weft rod together with said thread guide means are displaceable in the axial direction of said weft rod relative to said crank.

10. Thread control device according to claim 9, comprising a sleeve mounted in said support means to be rotatable relative thereto, said weft rod being slidably engaged in said sleeve and said crank being rigidly connected to said sleeve, a first arm connected to said weft rod to be pivotable therewith, a second arm connected to said sleeve to be pivotable therewith, and a connecting rod which extends parallel to said weft rod and interconnects said first and second arms to be secure against relative pivotal movement but displaceable relative to each other in the axial direction of said weft rod.

11. A method of operating a thread control device of a machine for producing textile material including thread guide means mounted for pivotal movement about a pivot axis, a crank operatively connected to the thread guide means and pivotable therewith but restricted against movement parallel to said axis, drive transmission means mounted for reciprocating motion in a plane parallel to said pivot axis, and connecting means connected between the drive transmission means and the crank for converting the reciprocating motion of the drive transmission means into pivotal motion about the pivot axis, comprising, reciprocatingly moving said drive transmission means in said plane parallel to said pivot axis to cause said connecting means to effect oscillatory pivotation of said crank and thereby said thread guide means about said pivot axis.

12. A method according to claim 11, comprising additionally displacing said thread guide means in a direction parallel to said pivot axis.

13. A method according to claim 12, comprising guiding a weft thread by said thread guide means in such a manner that said weft thread is layable into stitch formations of a textile material being produced by said machine and also layable laterally outwardly at said stitch formations to provide fringe elements in the finished textile material.

14. A method according to claim 12, comprising guiding a weft thread by said thread guide means in such a manner that in one pivotal position of said thread guide means the weft thread is transversely layable into parallelly extending stitch formations of a textile material being produced by said machine and in another pivotal position of said thread guide means the weft thread is conducted past said stitch formations.

15. A thread control machine comprising, at least one rod support, support drive means for moving said rod support, at least two weft rods movable in said at least one rod support, axial drive means connected to one of said at least two weft rods for moving said one weft rod axially in said support, radial drive means connected to another of said at least two weft rods for pivoting said other weft rod in said support, and thread guide means connected to each of said at least two weft rods for guiding a weft thread to be controlled by the thread control machine.

16. A thread control machine according to claim 15, wherein said radial drive means comprises a crank connected to said other weft rod for pivotal motion therewith, a drive transmission mounted for reciprocating motion in a plane parallel to a pivot axis of said other weft rod connected to said crank for converting reciprocating motion of said drive transmission into pivotal motion of said crank and said other weft rod.

17. A thread control machine according to claim 16, wherein said other weft rod is mounted also for axial movement in said rod support and additional axial drive means connected to said other weft rod for moving said other weft rod axially in said support, said crank being axially fixed with respect to said at least one support.

18. A thread control machine according to claim 15, including an additional weft rod axially movable in said at least one support carrying an additional weft thread guide means.

* * * * *